US011415083B1

(12) United States Patent
Kavuri et al.

(10) Patent No.: US 11,415,083 B1
(45) Date of Patent: Aug. 16, 2022

(54) ENGINE SYSTEMS AND METHODS

(71) Applicant: Caterpillar Inc., Peoria, IL (US)

(72) Inventors: Chaitanya Kavuri, Peoria, IL (US); Jonathan W. Anders, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/371,794

(22) Filed: Jul. 9, 2021

(51) Int. Cl.

| | |
|---|---|
| ***F02M 21/02*** | (2006.01) |
| ***F02M 26/34*** | (2016.01) |
| ***F02M 25/03*** | (2006.01) |
| ***F01N 3/20*** | (2006.01) |
| ***F02B 75/18*** | (2006.01) |
| ***F02B 15/00*** | (2006.01) |

(52) U.S. Cl.
CPC ..... *F02M 21/0209* (2013.01); *F01N 3/2066* (2013.01); *F02B 15/00* (2013.01); *F02B 75/18* (2013.01); *F02M 25/03* (2013.01); *F02M 26/34* (2016.02); *F01N 2610/02* (2013.01); *F01N 2610/1453* (2013.01); *F02B 2075/1808* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,924,576 | A * | 12/1975 | Siewert | F02B 1/06 123/1 R |
| 4,186,561 | A | 2/1980 | Wishart | |
| 5,325,824 | A | 7/1994 | Wishart | |
| 6,340,004 | B1 * | 1/2002 | Patton | F02G 1/02 123/70 R |
| 6,899,061 | B1 * | 5/2005 | Loth | F02B 11/00 123/27 R |
| 7,013,637 | B2 | 3/2006 | Yoshida | |
| 7,493,886 | B2 | 2/2009 | Blank | |
| 7,958,872 | B1 | 6/2011 | Schechter | |
| 8,469,009 | B2 | 6/2013 | Munshi et al. | |
| 8,807,099 | B2 | 8/2014 | Branyon et al. | |
| 8,904,765 | B2 | 12/2014 | Miyagawa et al. | |
| 9,249,720 | B2 | 2/2016 | Miyagawa | |
| 9,284,877 | B2 | 3/2016 | Yoo et al. | |
| 9,297,295 | B2 * | 3/2016 | Scuderi | F02B 33/22 |
| 9,556,770 | B2 | 1/2017 | Sandou | |
| 10,167,786 | B2 | 1/2019 | McTaggart-Cowan et al. | |
| 10,718,258 | B2 | 7/2020 | Solomon et al. | |
| 11,092,066 | B2 * | 8/2021 | Atkins | F02B 29/0406 |

(Continued)

FOREIGN PATENT DOCUMENTS

| | | | |
|---|---|---|---|
| CN | 109707504 | A | 5/2019 |
| DE | 10332047 | B4 | 10/2015 |

(Continued)

*Primary Examiner* — Binh Q Tran
(74) *Attorney, Agent, or Firm* — Bookoff McAndrews PLLC

(57) ABSTRACT

An engine system includes a first cylinder including a first piston, a second cylinder including a second piston, and a fuel injector fluidly connected to the first cylinder. The first cylinder is a combustion cylinder, and the second cylinder is an expansion cylinder. The second cylinder is fluidly connected to the first cylinder when the first piston is in at least one position in the first cylinder. The fuel injector is configured to deliver hydrogen gas to the first cylinder.

20 Claims, 2 Drawing Sheets

(56) References Cited

U.S. PATENT DOCUMENTS

| | | | | |
|---|---|---|---|---|
| 2004/0123821 | A1* | 7/2004 | Hu | F02B 41/08 123/58.8 |
| 2008/0202454 | A1* | 8/2008 | Pirault | F02B 47/02 123/58.8 |
| 2020/0232365 | A1 | 7/2020 | Robel | |

FOREIGN PATENT DOCUMENTS

| | | | |
|---|---|---|---|
| GB | 1527130 | A | 10/1978 |
| JP | H04325723 | A | 11/1992 |
| JP | 2008291726 | A | 12/2008 |
| KR | 101939184 | B1 | 1/2019 |
| KR | 20200118624 | A | 10/2020 |

* cited by examiner

ENGINE SYSTEMS AND METHODS

TECHNICAL FIELD

The present disclosure relates generally to internal combustion engines, and more particularly, to injection and emissions treatment systems and methods for such internal combustion engines.

BACKGROUND

Split cycle engines typically include a combustion cylinder and an expansion cylinder, with pistons in the cylinders driving the rotation of a crankshaft. Operation of the engine generates combustion products, which may require one or more treatment procedures in order to reduce potential harmful and/or dangerous gases. Moreover, one or more treatment procedures may require additional engine components and/or reduce engine operating efficiency. For example, split cycle engines may be powered by injecting and combusting hydrogen, which may generate nitrogen oxide gases (i.e., NO and $NO_2$ gases), commonly referred to as NOx. The generation and corresponding management of NOx may limit the power generation, efficiency, performance, etc. of the split cycle engine.

U.S. Pat. No. 8,469,009, issued on Jun. 25, 2013 ("the '009 patent"), describes a gaseous-fueled internal combustion split cycle engine that is powered by a mixture of hydrogen and natural gas. The '009 patent discloses controlling respective concentrations of the mixture of hydrogen and natural gas and controlling the injection timing. Controlling the respective concentrations and the injection timing helps to improve combustion stability and reduce emissions of nitrogen oxide gas, exhaust particulate matter, and unburned hydrocarbons. However, the engine and methods disclosed by the '009 patent require a mixture of hydrogen and natural gas, which may result in the combustion generating soot and other harmful exhaust products, which may require additional treatment and/or impair the overall efficiency and power of the engine.

The systems and methods of the present disclosure may address or solve one or more of the problems set forth above and/or other problems in the art. The scope of the current disclosure, however, is defined by the attached claims, and not by the ability to solve any specific problem.

SUMMARY

In one aspect, an engine system may include a first cylinder including a first piston, a second cylinder including a second piston, and a fuel injector fluidly connected to the first cylinder. The first cylinder may be a combustion cylinder, and the second cylinder may be an expansion cylinder. The second cylinder may be fluidly connected to the first cylinder when the first piston is in at least one position in the first cylinder. The fuel injector may be configured to deliver hydrogen gas to the first cylinder.

In another aspect, a hydrogen powered engine system may include a crankshaft, a first cylinder, a second cylinder, a fuel source, and a fuel injector. The first cylinder may include a first piston coupled to the crankshaft, and the first cylinder may be a combustion cylinder. The second cylinder may include a second piston coupled to the crankshaft, and the second cylinder may be an expansion cylinder. The second cylinder may be fluidly connected to the first cylinder via a gas crossover passage that allows combustion products to pass from the first cylinder to the second cylinder when the first piston is in at least one position in the first cylinder. The fuel source may contain a supply of hydrogen gas. The fuel injector may be fluidly connected to the fuel source and to the first cylinder. The fuel injector may be configured to deliver the hydrogen gas to the first cylinder.

In yet another aspect, a hydrogen powered engine system may include a first cylinder, a second cylinder, a fuel source, and a fuel injector. The first cylinder may include a first piston, and the first cylinder may be a combustion cylinder. The second cylinder may include a second piston, and the second cylinder may be an expansion cylinder. The second cylinder may be fluidly connected to the first cylinder. The fuel source may contain a supply of hydrogen gas. The fuel injector may be fluidly connected to the fuel source and to the first cylinder. The fuel injector may be configured to deliver the hydrogen gas to the first cylinder for a duration between approximately 15° crank angle and approximately 25° crank angle.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, system, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
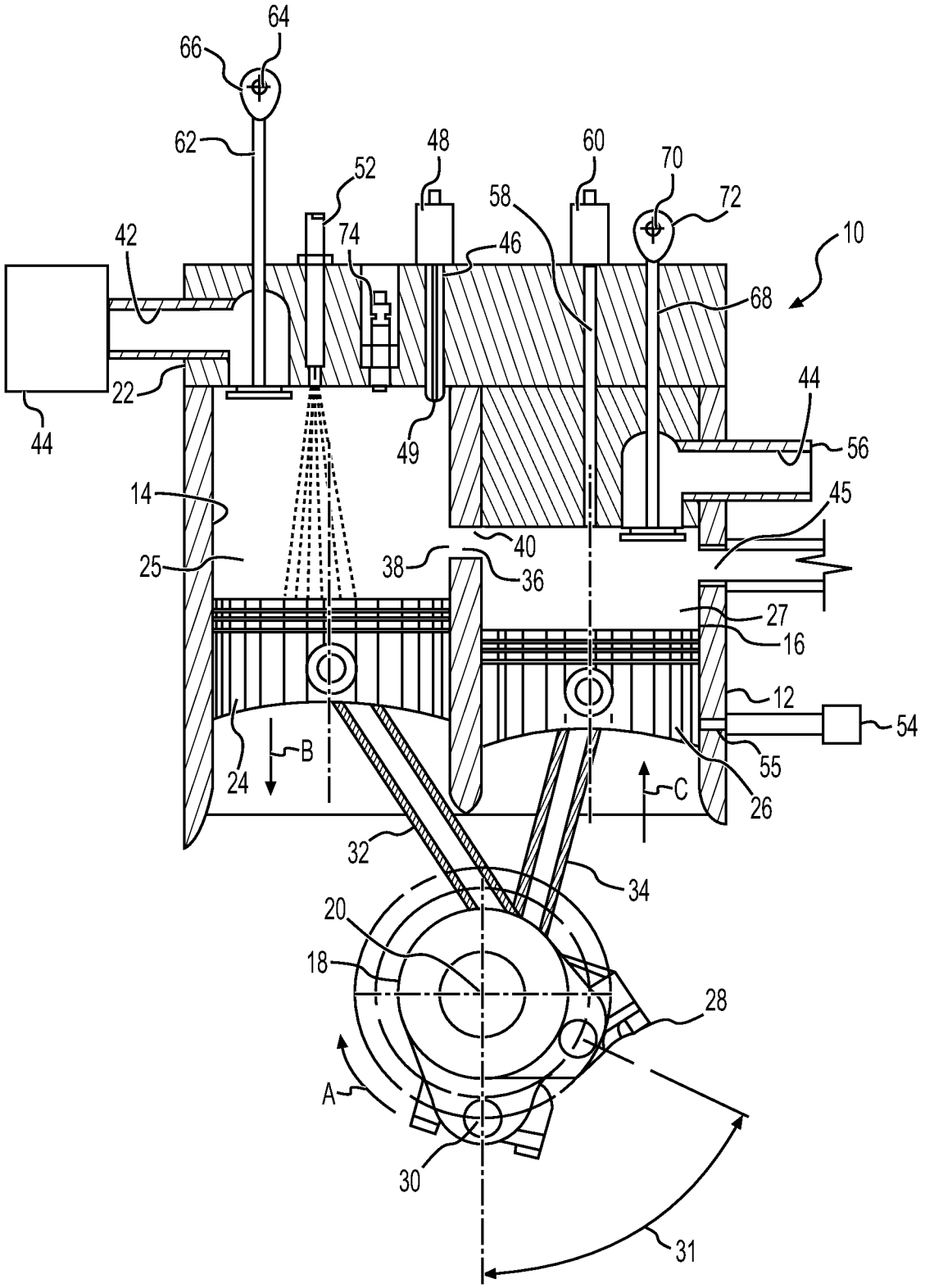
FIG. 1 illustrates a partially schematic internal combustion engine system having a combustion cylinder and an exhaust cylinder, according to aspects of the disclosure.

FIG. 1 illustrates a split cycle engine system 10 ("engine 10"), including an engine block 12. As discussed below, engine 10 may divide four strokes between two paired cylinders, with one cylinder for intake and compression, and another cylinder for power and exhaust. As discussed in detail below, engine 10 may be a hydrogen powered engine system, for example, receiving and combusting hydrogen gas (i.e., $H_2$ gas). Engine 10 includes a first cylinder, for example, a combustion or firing first cylinder 14, in which hydrogen gas is combusted. Engine 10 also includes a second cylinder, for example, an expansion or exhaust cylinder 16, in which combusted products expand and/or cool, for example, to an ambient temperature. In this aspect, first cylinder 14 may be used for intake and compression of injected hydrogen, and second cylinder 16 may be used for power and exhaust. In one or more aspects, engine 10 may be any type of engine, which may include two cylinders (as shown) or more than two cylinders, for example, a third cylinder in which exhaust gas or combustion products may further expand. Alternatively or additionally, engine may include an additional cylinder, for example, to provide further compression to the intake air and/or hydrogen gas prior to combustion. First cylinder 14 and second cylinder 16 may be adjacent to each other in engine block 12. A crankshaft 18 may be coupled to engine block 12, for example, journaled in engine block 12. Crankshaft 18 may be rotatable about a crankshaft axis 20, for example, extending perpendicular to the plane of the page. Upper ends of first and second cylinders 14, 16 may be closed by a cylinder head 22.

Furthermore, the first cylinder 14 and second cylinder 16 and any additional cylinders added to this set can be treated as a module. Based on the target power requirements, there may be multiple copies or sets of these modules that could be connected to the crankshaft. For example, although not shown, there could be two sets of the cylinder arrangement that forms engine 10 shown in FIG. 1, for example to double the power output.

First cylinder 14 and second cylinder 16 each define internal bearing surfaces. First cylinder 14 receives a first piston 24, which may be a combustion or power piston. Second cylinder 16 receives a second piston 26, which may be an expansion piston. First cylinder 14, cylinder head 22, and first piston 24 define a variable volume combustion chamber 25 in first cylinder 14. Second cylinder 16, cylinder head 22, and second piston 26 define a variable volume expansion or exhaust chamber 27 in second cylinder 16. Movement of first piston 24 in first cylinder 14 and/or movement of second piston 26 in second cylinder 16 may rotate crankshaft 18.

Crankshaft 18 includes a first crank throw 28 and a second crank throw 30. First crank throw 28 and second crank throw 30 may be axially displaced and angularly offset from each other, for example, having a phase angle 31 between first crank throw and second crank throw. First crank throw 28 may be pivotally coupled to first piston 24 by a first connecting rod 32, and second crank throw 30 may be pivotally coupled to second piston 26 by a second connecting rod 34. In these aspects, rotation of crankshaft 18, for example, in a clockwise direction, shown as arrow A, may reciprocate first piston 24 within first cylinder 14, and may also reciprocate second piston 26 within second cylinder 16. In this aspect, as first piston 24 is moving down toward its bottom dead center (BDC) position (as shown by arrow B) to increase the size of variable volume combustion chamber 25, second piston 26 is moving up away from its bottom dead center (BDC) (as shown by arrow C) to reduce the size of variable volume expansion or exhaust chamber 27.

Additionally, the angular offset (i.e., phase angle 31) between first crank throw 28 and second crank throw 30 may affect a timed relation between the reciprocation of first piston 24 and second piston 26. Geometric relationships of first cylinder 14, second cylinder 16, first piston 24, second piston 26, first crank throw 28, second crank throw 30, etc. may also affect the timed relation between the reciprocation of first piston 24 and second piston 26. Although not shown, one or more alternative mechanisms for relating the motion and timing of first piston 24 and second piston 26 may be utilized.

Cylinder head 22 and/or engine block 12 may include various conduits, passages, ports, valves, etc. that are suitable for split-cycle engine 10. As shown in FIG. 1, engine block 12 includes a gas crossover passage 36, for example, fluidly connecting first cylinder 14 and second cylinder 16. Gas crossover passage 36 includes an inlet port 38 opening into first cylinder 14 and an outlet port 40 opening into second cylinder 16. Gas crossover passage 36 may connect a middle portion of first cylinder 14 with a top portion of second cylinder 16. In this aspect, when first piston 24 is positioned below gas crossover passage 36, one or more gases (e.g., combustion products) may pass from first cylinder 14 into second cylinder 16, for example, pushing second piston 26 downward within second cylinder 16.

First cylinder 14 is fluidly connected to an air inlet port 42, which may be connected to a compressor 44. Compressor 44 may deliver air from an air intake and/or from second cylinder 16 to first cylinder 14, for example, via air inlet port 42. As discussed below, compressor 44 may be coupled to an exhaust conduit 45 that extends through a portion of engine block 12 to second cylinder 16, and may combine and/or mix exhaust from second cylinder 16 with fresh air before delivering the exhaust-air combination to first cylinder 14.

Figure 2:
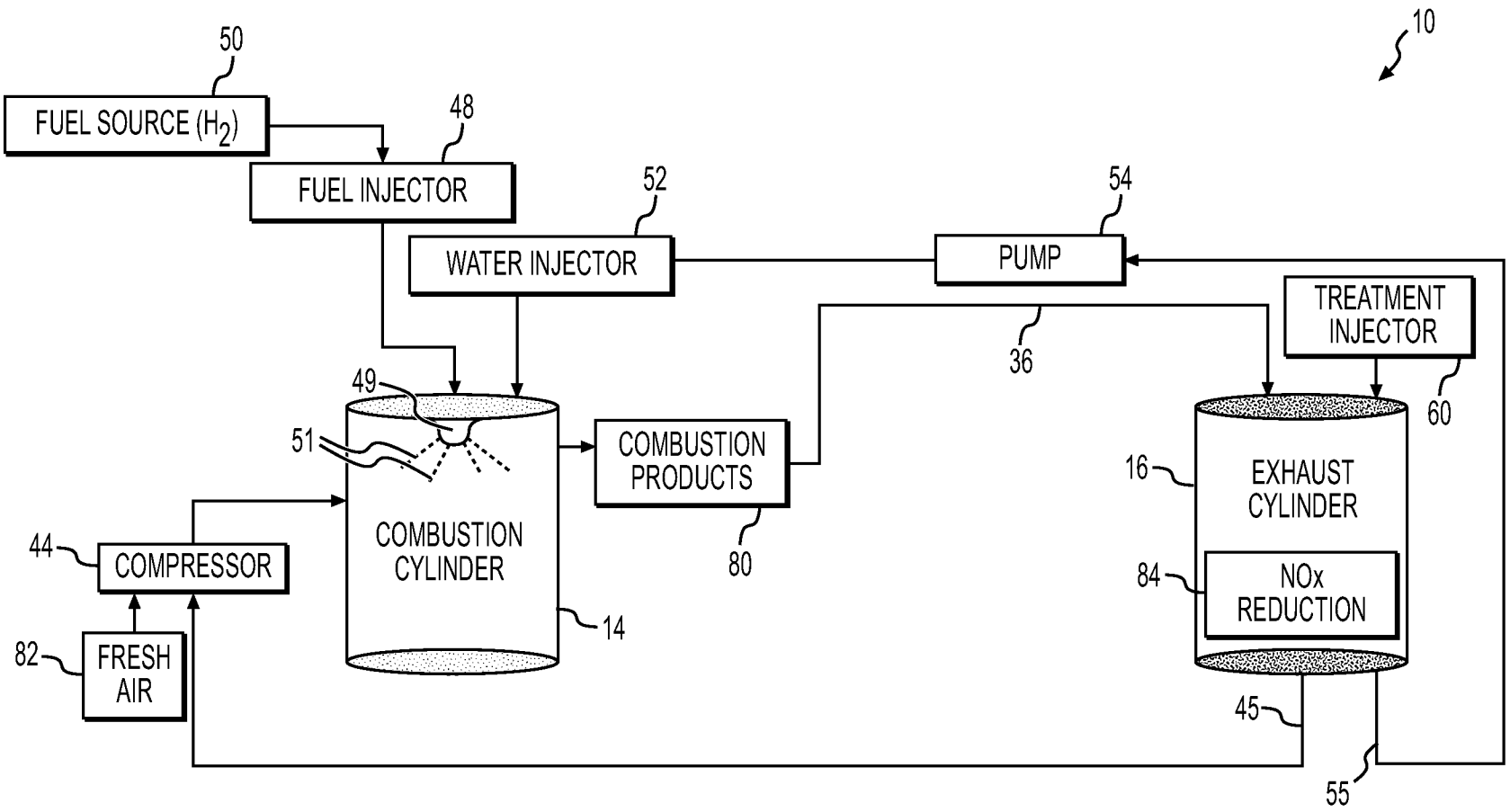
FIG. 2 is a schematic view of the internal combustion engine system of FIG. 1, according to aspects of the disclosure.

First cylinder 14 also is fluidly connected to an injection port 46, which may be connected to a fuel injector 48. As shown in FIG. 2, fuel injector 48 may be fluidly connected to a fuel source 50, for example, a supply of hydrogen gas ($H_2$). In this aspect, fuel source 50 may contain pure hydrogen gas ($H_2$). Fuel injector 48 may include a tip 49, for example, a dome-shaped tip, to deliver a spray 51 of fuel, as shown in FIG. 2. In one aspect, fuel injector 48 may include a plurality of injection holes on tip 49, for example, approximately three to approximately ten holes. In one aspect, fuel injector 48 may include approximately five to approximately eight holes on tip 49. Additionally, the holes of fuel injector 48 may each include a diameter between approximately 200 μm and approximately 700 μm. For example, the holes of fuel injector 48 may each include a diameter between approximately 400 μm and approximately 500 μm. In one or more aspect, the holes on tip 49 of fuel injector 48 may include a spray 51 with range of between approximately 80 degrees and approximately 140 degrees, for example, between approximately 100 degrees and approximately 120 degrees. Additionally, fuel injector 48 may direct the hydrogen gas in one or more directions relative to one or more portions of first cylinder 14 and/or first piston 24. For example, fuel injector 48 may direct the hydrogen gas toward a lowest portion and/or farthest away portion of an injection bowl (not shown). Moreover, although not shown, the injection bowl may include a conical shape, for example, to help the combustion of the hydrogen gas under the various injection parameters discussed herein.

Furthermore, in one or more aspects, first cylinder 14 may be connected to a water injector 52. For example, water injector 52 may be fluidly connected to a water source (not shown). Alternatively or additionally, as shown in FIG. 2, water injector 52 may be fluidly connected to a portion of second cylinder 16, for example, to collect and recirculate water that accumulates in second cylinder 16, for example, during the expansion of combustion products that result from the combustion of hydrogen gas. In these aspects, as shown in FIGS. 1 and 2, a pump 54 may be fluidly connected to a portion of second cylinder 16 and to a portion of first cylinder 14, and pump 54 may direct water or other fluids from second cylinder 16 to first cylinder 14, for example, via water injector 52. For example, pump 54 may be coupled to a water conduit 55 that extends through a portion engine block 12 to second cylinder 16.

Second cylinder 16 also fluidly connects to an exhaust port 56, for example, to discharge exhaust into the atmosphere. Moreover, second cylinder 16 may fluidly connect with a treatment passage 58. Treatment passage 58 may be fluidly connected to a treatment injector 60. For example, treatment injector 60 may deliver one or more treatment (e.g., aftertreatment) chemicals to second cylinder 16, which may help to reduce and/or modify the properties of the exhaust gas in second cylinder 16. In one or more aspects, treatment injector 60 may deliver urea to second cylinder 16. Alternatively or additionally, treatment injector 60 may deliver additional hydrogen gas ($H_2$) to second cylinder 16.

One or more valves may control one or more of the above-discussed fluid flows. For example, engine 10 may include an intake valve 62, for example, including a camshaft 64 with a cam lobe 66. Intake valve 62 may help to control the flow of compressed air (either alone or mixed with exhaust) into first cylinder 14. Alternatively or additionally, intake valve 62 may help to prevent combusted air from flowing back out of first cylinder 14 and into air inlet port 42 and/or toward compressor 44. Engine 10 may also include an outlet valve 68, for example, including a camshaft 70 and a cam lobe 72. Outlet valve 68 may help to control the flow of combustion products and other resulting gases and/or materials from second cylinder 16, for example, to release combustion products, gases, materials, etc. into the atmosphere. Additionally, although not shown, engine 10 may include one or more check valves, pressure relief valves, etc.

Furthermore, a spark plug 74 may be mounted in or otherwise be coupled to engine block 12 and/or cylinder head 22. Spark plug 74 may include one or more electrodes extending into first cylinder 14 and variable volume combustion chamber 25 for igniting air-fuel charges. The ignition may be controlled by an ignition control (not shown), for example, with the ignition being executed at precise times relative to the operating cycle of engine 10, for example, including first piston 24. Alternatively, engine 10 may include one or more additional or separate heating elements, for example, a heating dome within first cylinder 14 for ignition, and the one or more heating elements also may be controlled by an ignition control (not shown).

FIG. 2 is a schematic view of engine 10, including various features that may help to increase the efficiency and/or output of engine 10 and/or that may help to reduce heat generation, engine emissions, etc. As discussed above, engine 10 includes first cylinder 14 and second cylinder 16. First cylinder 14 and second cylinder 16 are fluidly connected, for example, via gas crossover passage 36. In this aspect, combustion products 80 may be directed from first cylinder 14 to second cylinder 16. For example, fuel products in first cylinder 14 may undergo combustion in first cylinder 14, which may generate combustion products 80. Then, combustion products 80 may be transferred from first cylinder 14 to second cylinder 16. Combustion products 80 may then expand in second cylinder 16. As mentioned, engine 10 may receive hydrogen gas (e.g., $H_2$) from fuel source 50, and also may receive air from compressor 44. In this aspect, combustion products 80 may include one or more of water (e.g., as steam), nitrogen oxide, hydrogen gas that did not undergo combustions, oxygen gas (e.g., 02), etc.

As discussed above, engine 10 may include compressor 44, which may receive and direct air and exhaust gas into first cylinder 14. For example, compressor 44 may include a source or an intake of fresh air 82, for example, fluidly connected to an exterior of engine 10, for example, an exterior of a vehicle or machine that is powered by engine 10. Compressor 44 may also be fluidly connected to second cylinder 16, for example, to receive exhaust gases from second cylinder 16. In this aspect, compressor 44 may direct exhaust gases from second cylinder 16 for exhaust gas recirculation (EGR), for example, via exhaust conduit 45. Compressor 44 may combine and/or mix the received fresh air from the source or intake of fresh air 82 and the exhaust gases received from second cylinder 16, and compressor 44 may direct a combination of fresh air and exhaust gas into first cylinder 14. For example, compressor 44 may compress the combination of fresh air (i.e., from the source or intake of fresh air 82) and exhaust gas (i.e., from second cylinder 16) before directing the combination of fresh air and exhaust gas into first cylinder 14. In one or more aspects, the combination of fresh air and exhaust gas may include a concentration of greater than or equal to approximately 40% exhaust gas. In this aspect, fresh air may comprise the remainder of the fluid delivered by compressor 44 to first cylinder 14. In these aspects, a method of operating engine 10 may include recirculating exhaust gases from the second cylinder 16, through compressor 44, and into first cylinder 14, according to one or more of the above parameters.

Additionally, engine 10 may include fuel injector 48, which may receive and direct fuel into first cylinder 14. As discussed above, fuel injector 48 may receive and direct hydrogen gas (e.g., $H_2$) into first cylinder 14, for example, for hydrogen direct injection. For example, fuel injector 48 may be fluidly connected to fuel source 50, and fuel source 50 may contain a supply of hydrogen gas (e.g., $H_2$). In one or more aspects, fuel injector 48 may include tip 49, which may be a domed tip, to direct the hydrogen gas into first cylinder 14. Fuel injector 48 may inject the hydrogen gas into first cylinder 14 at an injection pressure that is less than or equal to approximately 600 bar, for example, less than or equal to approximately 400 bar. In one or more aspects, fuel injector 48 may direct hydrogen gas into first cylinder 14 at a start of injection (SOI) in a range between approximately 30° before top dead center (bTDC) and approximately 0° before top dead center, for example, at top dead center. For example, fuel injector 48 may direct hydrogen gas into first cylinder 14 at a start of injection (SOI) in a range between approximately 10° before top dead center (bTDC) and approximately 0° before top dead center, for example, at top dead center. Furthermore, in one or more aspects, fuel injector 48 may inject fuel for a duration between 5° crank angle to 30° crank angle from the time of start of injection, for example for an injection duration of 15 crank angle degrees. In one aspect, fuel injector 48 may inject fuel for a duration between approximately 15° crank angle and up to approximately 25° crank angle, for example, for a duration of approximately 20 crank angle degrees. In these aspects, a method of operating engine 10 may include injecting the hydrogen into first cylinder 14, according to one or more of the above parameters.

Engine 10 may also include pump 54 to direct water from second cylinder 16 into first cylinder 14. For example, pump 54 may be fluidly connected to an outlet of second cylinder 16 (e.g., water conduit 55) and to an inlet (e.g., water injector 52) in first cylinder 14. Pump 54 may help to remove exhaust water (e.g., in a liquid state or in a gaseous state) from second cylinder 16. Additionally, pump 54 may direct water into first cylinder 14, for example, via water injector 52 (FIG. 1). In one or more aspects, pump 54 may include one or more cooling elements (e.g., a coolant flowing through a heat exchanger, one or more fans, etc.). For example, one or more cooling elements may be positioned such that the water interacts with the cooling elements prior to the water entering pump 54. In these aspects, the one or more cooling elements may help cool water (either as a liquid or a gas) removed from second cylinder 16, such that cooler water may be delivered to first cylinder 14. In another aspect, the water in second cylinder 16 may cool via expansion within second cylinder 16 and heat transfer after leaving second cylinder 16, and pump 54 may deliver the cooled water from second cylinder 16 to first cylinder 14, without any additional active cooling. Injecting water into first cylinder 14 may help to reduce the generation of nitrogen oxide gas (NOx) and/or increase the efficiency of the combustion in first cylinder 14. Moreover, pump 54 may help to recirculate water throughout engine 10. In this aspect, water injected into first cylinder 14 may be conveyed to second cylinder 16, for example, with combustion products 80 and/or as steam. Then, water in second cylinder 16 may expand and/or cool, and may be collected and returned to first cylinder 14 via pump 54. In these aspects, a method of operating engine 10 may include collecting water from second cylinder 16 and directing the water into first cylinder 14, for example, via pump 54 and water injector 52, according to one or more of the above parameters.

Moreover, in one or more aspects, engine 10 may include one or more treatment injectors 60, for example, on or within second cylinder 16. Treatment injector 60 may be positioned on or within second cylinder 16, and may deliver a treatment chemical, to within second cylinder 16, to help reduce the amount of NOx within second cylinder 16. In one example, treatment injector 60 may deliver and/or inject urea ($CO(NH_2)_2$) to within second cylinder 16. In another example, treatment injector 60 may deliver and/or inject of hydrogen gas (i.e., $H_2$ gas) to within second cylinder 16. In these aspects, a method of operating engine 10 may include injecting one or more treatment chemicals into second cylinder 16, according to one or more of the above parameters. Additionally, portions of the second cylinder 16 maybe coated with a catalytic compound to accelerate the NOx reduction 84. The NOx reduction process 84 converts NOx to nitrogen gas ($N_2$) and water ($H_2O$). The water may be directed to first cylinder 14, for example, via pump 54 and water injector 52. Additionally, the nitrogen gas may be directed to first cylinder 14, for example, via compressor 44. In these aspects, a method of operating engine 10 may include one or more NOx reduction 84 techniques in second cylinder 16, according to one or more of the above parameters.

It is noted that while FIGS. 1 and 2 illustrate engine 10 including a plurality of features that may help to increase the efficiency of engine 10 and/or help to reduce the production and/or emission of nitrogen oxide gases, engine 10 may include only one or more of these features. For example, engine 10 may only include the injection timings discussed above with respect to injector 48. Alternatively, engine 10 may only include the exhaust gas recirculation discussed above with respect to compressor 44. Furthermore, in one or more aspects, engine 10 may only include one or more treatment injectors 60. Nevertheless, it is noted that engine 10 may include more than one, but not all, of the plurality of features that may help to increase the efficiency of engine 10 and/or help to reduce the production and/or emission of nitrogen oxide gases.

INDUSTRIAL APPLICABILITY

The disclosed engine 10, including one or more of the aspects discussed herein, may be used to power any vehicle or machine. Additionally, various aspects of engine 10 may help to improve engine efficiency and/or performance, while also reducing the production and/or emission of harmful exhaust products (i.e., nitrogen gases). In some examples, various aspects of engine 10 may help to increase an efficiency of engine 10, for example, by approximately 5%, by approximately 10%, by approximately 20%, etc. Various aspects of engine 10 may help to reduce emissions, for example, by emitting only water as a byproduct and/or by emitting a reduced level of nitrogen oxide gases. Additionally, various aspects of engine 10 may also help to reduce overall costs of engine 10, for example, compared to diesel-powered engines with similar performance characteristics.

As discussed above, engine 10 may be a split-cycle engine, and may operate by combusting hydrogen gas (e.g., $H_2$ gas). In this aspect, engine 10 may divide four strokes between two paired cylinders, with one cylinder for intake and compression, and another cylinder for power and exhaust. For example, first cylinder 14 may be used for intake and compression of injected hydrogen, and second cylinder 16 may be used for power and exhaust. The hydrogen gas may combust at relatively high temperatures (approximately 3000 K or greater) relative to other combustion engines (i.e., diesel combusts at approximately 2700 K) for similar loads. Because hydrogen gas does not contain any carbon, the combustion of the hydrogen gas does not generate any soot or carbon dioxide ($CO_2$). Moreover, combusting hydrogen gas may generate little or no particulate matter or other emissions associated with other internal combustion engines. Combusting hydrogen gas may generate nitrogen oxide gases (NOx), which may limit the performance of engine 10. Nevertheless, because there is no carbon combusted or soot generated, engine 10 may include one or more features and/or components that may help to reduce the amount of nitrogen oxide gases that is generated during the combustion of hydrogen gas ($H_2$).

Engine 10 may include a delayed and/or retarded combustion phasing using late injection timings and/or extended durations. As mentioned above, fuel injector 48 may direct hydrogen gas (e.g., pure hydrogen gas) into first cylinder 14 at an injection pressure that is less than or equal to approximately 600 bar, for example, less than or equal to approximately 400 bar. For example, fuel injector 48 may direct hydrogen gas into first cylinder 14 at a start of injection (SOI) in a range between approximately 30° before top dead center (bTDC) and approximately 0° before top dead center, for example, at top dead center. In another aspect, fuel injector 48 may direct hydrogen gas into first cylinder 14 at a start of injection (SOI) in a range between approximately 10° before top dead center (bTDC) and approximately 0° before top dead center, for example, at top dead center. Furthermore, in one or more aspects, fuel injector 48 may inject fuel for a duration between approximately 5° crank angle to approximately 30° crank angle from the time of start of injection, for example for an injection duration of approximately 15 crank angle degrees. For example, fuel injector 48 may inject fuel for a duration between approximately 15° crank angle up to approximately 25° crank angle, for example, for a duration of approximately 20 crank angle degrees. These injection details (e.g., late injection timings and/or extended injection durations) may help to reduce the overall formation and/or emission of nitrogen oxide gases, which may help to improve the overall fluid consumption by allowing for an amount of hydrogen gas to generate a greater power from engine 10.

Furthermore, as discussed above, engine 10 may include water injector 52, which may direct water from second cylinder 16 into first cylinder 14, for example, via water conduit 55 and pump 54. Injecting water into first cylinder 14 may help to control (e.g., limit and/or reduce) the formation of nitrogen oxide and/or to control (e.g., limit and/or reduce) the temperatures within first cylinder 14. Engine 10 operates on hydrogen gas ($H_2$), and thus produces water, for example, as combustion products 80 cool and/or expand in second cylinder 16 and/or upon exiting second cylinder 16. The water may cool (i.e., condense) in second cylinder 16 and/or upon exiting second cylinder 16, for example, through expansion in second cylinder 16 and/or via heat transfer (e.g., with water conduit 55 and/or exhaust port 56) upon exiting second cylinder 16. Cooling the water in second cylinder 16, and/or via heat transfer after exiting second cylinder 16, does not require a separate active cooling system. Alternatively, one or more heat exchangers may be used to cool the water upon exiting second cylinder 16, for example, positioned between second cylinder 16 and pump 54. The water that condenses in second cylinder 16 and/or after exiting second cylinder 16 may be recirculated by pump 54 and injected into first cylinder 14 via water injector 52. The water may be injected into first cylinder before the injection of the hydrogen gas for combustion. Alternatively or additionally, the water may be injected into first cylinder 14 and/or second cylinder 16 during the transfer of gases (i.e., combustion products 80) from first cylinder 14 to second cylinder 16. As such, water may be injected into first cylinder 14 and/or second cylinder 16, without a need for a separate water supply. The water injection may help to control (e.g., limit and/or reduce) the in-cylinder temperatures, reduce the transfer of heat between first cylinder 14 and second cylinder 16, and, as a result, reduce the generation and/or emission of nitrogen oxide gases (NOx).

Additionally, engine 10 may include treatment injector 60, which may inject urea ($CO(NH_2)_2$) into second cylinder 16. As mentioned above, hydrogen gas combusts at a high temperature relative to other combustible gases, so second cylinder 16 experiences high temperatures during its cycle, for example, as combustion products 80 expand to ambient temperature. Additionally, second cylinder 16 may have a relatively large closed controlled volume during the expansion process. The high temperatures and expansion in second cylinder 16 may provide a suitable environment for urea to be directly injected into second cylinder 16 and treat combustion products 80 in second cylinder 16 to reduce the amount of nitrogen oxide gases (NOx). In one or more aspects, injecting urea into second cylinder 16 may reduce the formation and/or emission of nitrogen oxide gases (NOx) without a need for a separate selective catalyst reduction system. Alternatively or additionally, treatment injector 60 may deliver hydrogen gas ($H_2$) to second cylinder 16, which may also reduce the formation and/or emission of nitrogen oxide gases (NOx) without a separate selective catalyst reduction system.

Various aspects of this disclosure may help to improve the overall performance of a hydrogen engine. For example, various aspects of this disclosure may help to increase the power generated by engine 10 and/or improving the performance efficiency of engine 10. Moreover, as discussed above, various aspects of this disclosure may help to reduce the formation and/or emission of nitrogen oxide gases (NOx).

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An engine system, comprising:

a first cylinder including a first piston, wherein the first cylinder is a combustion cylinder;

a second cylinder including a second piston, wherein the second cylinder is an expansion cylinder, and wherein the second cylinder is fluidly connected to the first cylinder when the first piston is in at least one position in the first cylinder; and a fuel injector fluidly connected to the first cylinder, wherein the fuel injector is configured to deliver hydrogen gas to the first cylinder.

2. The engine system of claim 1, wherein the fuel injector is configured to deliver the hydrogen gas to the first cylinder at an injection pressure that is less than or equal to approximately 600 bar.

3. The engine system of claim 2, wherein the fuel injector is further configured to deliver the hydrogen gas to the first cylinder at a start of injection (SOI) in a range between approximately 30° before top dead center and approximately 0° before top dead center.

4. The engine system of claim 3, wherein the fuel injector is further configured to deliver the hydrogen gas to the first cylinder for a duration between approximately 5° crank angle and approximately 30° crank angle.

5. The engine system of claim 1, further comprising a compressor, wherein the compressor is fluidly connected to the first cylinder, the second cylinder, and a fresh air source, such that the compressor mixes one or more exhaust gases from the second cylinder with air from the fresh air source and injects the mix of the one or more exhaust gases and the air into the first cylinder.

6. The engine system of claim 1, further comprising a pump and a water injector, wherein the water injector is fluidly connected to the first cylinder, wherein the pump is fluidly connected to the second cylinder and the water injector, such that the pump delivers water from the second cylinder to the water injector, and such that the water injector delivers the water to the first cylinder.

7. The engine system of claim 1, further comprising a treatment injector fluidly connected to the second cylinder, wherein the treatment injector is configured to deliver one or more treatment chemicals into the second cylinder.

8. The engine system of claim 7, the one or more treatment chemicals includes one or more of urea or additional hydrogen gas.

9. A hydrogen powered engine system, comprising:

a crankshaft;

a first cylinder including a first piston coupled to the crankshaft, wherein the first cylinder is a combustion cylinder;

a second cylinder including a second piston coupled to the crankshaft, wherein the second cylinder is an expansion cylinder, and wherein the second cylinder is fluidly connected to the first cylinder via a gas crossover passage that allows combustion products to pass from the first cylinder to the second cylinder when the first piston is in at least one position in the first cylinder;

a fuel source containing a supply of hydrogen gas; and a fuel injector fluidly connected to the fuel source and to the first cylinder, wherein the fuel injector is configured to deliver the hydrogen gas to the first cylinder.

10. The engine system of claim 9, wherein the fuel injector is configured to deliver the hydrogen gas to the first cylinder at an injection pressure that is less than or equal to approximately 400 bar.

11. The engine system of claim 10, wherein the fuel injector is further configured to deliver the hydrogen gas to the first cylinder at a start of injection (SOI) in a range between approximately 10° before top dead center and approximately 0° before top dead center.

12. The engine system of claim 11, wherein the fuel injector is further configured to deliver the hydrogen gas to the first cylinder for a duration between approximately 15° crank angle and approximately 25° crank angle.

13. The engine system of claim 9, further comprising a compressor, wherein the compressor is fluidly connected to the first cylinder, the second cylinder, and a fresh air source, such that the compressor mixes one or more exhaust gases from the second cylinder with air from the fresh air source and injects the mix of the one or more exhaust gases and the air into the first cylinder.

14. The engine system of claim 9, further comprising a pump and a water injector, wherein the water injector is fluidly connected to the first cylinder, wherein the pump is fluidly connected to the second cylinder and the water injector, such that the pump delivers water from the second cylinder to the water injector, and such that the water injector delivers the water to the first cylinder to reduce an amount of nitrogen oxide gas in the first cylinder.

15. The engine system of claim 9, further comprising a treatment injector fluidly connected to the second cylinder, wherein the treatment injector is configured to deliver urea or additional hydrogen gas into the second cylinder to reduce an amount of nitrogen oxide gas in the second cylinder.

16. A hydrogen powered engine system, comprising:

a first cylinder including a first piston, wherein the first cylinder is a combustion cylinder;

a second cylinder including a second piston, wherein the second cylinder is an expansion cylinder, and wherein the second cylinder is fluidly connected to the first cylinder;

a fuel source containing a supply of hydrogen gas; and a fuel injector fluidly connected to the fuel source and to the first cylinder, wherein the fuel injector is configured to deliver the hydrogen gas to the first cylinder for a duration between approximately 15° crank angle and approximately 25° crank angle.

17. The engine system of claim 16, wherein the fuel injector is configured to deliver the hydrogen gas to the first cylinder at an injection pressure that is less than or equal to approximately 400 bar, and wherein the fuel injector is further configured to deliver the hydrogen gas to the first cylinder at a start of injection (SOI) in a range between approximately 10° before top dead center and approximately 0° before top dead center.

18. The engine system of claim 17, further comprising a compressor, wherein the compressor is fluidly connected to the first cylinder, the second cylinder, and a fresh air source, such that the compressor mixes one or more exhaust gases from the second cylinder with air from the fresh air source and injects the mix of the one or more exhaust gases and the air into the first cylinder.

19. The engine system of claim 16, further comprising a pump and a water injector, wherein the water injector is fluidly connected to the first cylinder, wherein the pump is fluidly connected to the second cylinder and the water injector, such that the pump delivers water from the second cylinder to the water injector, and such that the water injector delivers the water to the first cylinder to reduce an amount of nitrogen oxide gas in the first cylinder.

20. The engine system of claim 16, further comprising a treatment injector fluidly connected to the second cylinder, wherein the treatment injector is configured to deliver urea or additional hydrogen gas into the second cylinder to reduce an amount of nitrogen oxide gas in the second cylinder.

* * * * *